US006475290B2

(12) United States Patent
Jones

(10) Patent No.: US 6,475,290 B2
(45) Date of Patent: Nov. 5, 2002

(54) CLEANING SOLUTION TO REMOVE HYDROCARBONS FROM A SUBSTRATE

(75) Inventor: David H. Jones, Valley Village, CA (US)

(73) Assignee: Earth Alive Resources Inc., Waterloo (CA)

( * ) Notice: Subject to any disclaimer, the term of this patent is extended or adjusted under 35 U.S.C. 154(b) by 0 days.

(21) Appl. No.: 09/978,978

(22) Filed: Oct. 16, 2001

(65) Prior Publication Data

US 2002/0044887 A1 Apr. 18, 2002

Related U.S. Application Data

(60) Provisional application No. 60/241,397, filed on Oct. 17, 2000.

(51) Int. Cl.[7] ..... C23G 1/02

(52) U.S. Cl. ..... 134/2; 134/36; 134/42; 435/264; 510/493; 510/495

(58) Field of Search ..... 435/264; 134/2, 134/36, 42; 510/493, 495

(56) References Cited

U.S. PATENT DOCUMENTS 3,152,983 A * 10/1964 Davis et al. ..... 210/611
3,511,707 A * 5/1970 La Flamme et al. ..... 134/2
3,871,956 A * 3/1975 Azarowics ..... 210/611
4,035,289 A * 7/1977 Guillerme et al. ..... 210/610
5,532,162 A * 7/1996 Aamot ..... 210/601
5,654,192 A * 8/1997 Ducreux et al. ..... 435/101
5,733,744 A * 3/1998 Hamilton ..... 435/252.3
5,863,882 A * 1/1999 Lin et al. ..... 435/247
6,051,411 A * 4/2000 Turtakovsky et al. ..... 435/177
6,288,015 B1 * 9/2001 Moeller et al. ..... 510/180
2002/0044887 A1 * 4/2002 Jones
2002/0063095 A1 * 5/2002 Jones

FOREIGN PATENT DOCUMENTS

WO WO00/78905A! * 12/2000

* cited by examiner

*Primary Examiner*—Sharidan Carrillo
(74) *Attorney, Agent, or Firm*—Eric Fincham

(57) ABSTRACT

A method for the cleaning of a substrate having an organic compound such as a hydrogenic compound thereon, the method comprising the step of applying to the substrate a composition comprising a lignosulfonate and a microbially effective amount of microorganisms in an aqueous solution. The method is ideally practiced to achieve the microbial degradation of hydrocarbons and can be used as a parts washing solution and for cleaning substrates such as floors, decks of vessels, etc.

5 Claims, No Drawings

CLEANING SOLUTION TO REMOVE HYDROCARBONS FROM A SUBSTRATE

The present application claims the benefit of Provisional Application Ser. No. 60/241,397 filed Oct. 17, 2000.

FIELD OF THE INVENTION

The present invention relates to a cleaning or washing solution and to a method of cleaning or washing hydrocarbon based material from a substrate.

BACKGROUND OF THE INVENTION

Solvents are widely used in various automotive and industrial parts washing equipment. As such, petroleum based solvents and even ordinary aqueous cleaners require periodic disposal of the contaminated solution by expensive hazardous waste hauling services. In turn, these services are required to treat the contaminated solution. It has been proposed in the art to use organic microbial cleaning solutions to replace such solvents and aqueous cleaning solutions. However, the cost of doing so has been substantial and accordingly, the process has not gained a wide degree of acceptance to date.

The use of microbes for the microbial degradation of hydrocarbons by treating the same with particular microorganisms which are capable of using the hydrocarbon as an energy and carbon source is well known in the art. The process has been used to clean up oil spillage as it has occurred on various waterways. It is also being used for the cleaning of oil transport vessels and/or storage tanks. However, the process is relatively expensive to practice.

Many different types of hydrocarbons are utilized in different industrial applications. Hydrocarbons are generally derived from petroleum based materials and are a complex mixture of straight chain and branched alkanes or alkenes, saturated ring compounds and aromatic compounds. Industrial hydrocarbon products include gasoline, kerosene, burner fuel oil, diesel oil, gas turbine oil, aviation fuels, lubricating oils and hydrocarbon greases. As will be appreciated, such products have a widespread use and it is frequently necessary to clean up spills or other contamination of a substrate by such hydrocarbon products.

In the art, various methods for cleaning hydrocarbon contaminated substrates have been proposed. These include the physical removal of the product by use of absorption media, dispersal detergents, microbial degradation, agglomeration, and the use of organic chemicals.

For many years, hydrocarbon contamination was not considered a problem and the procedure for controlling environmental damage was to ship the undesirable contaminants to a secure landfill. However, this is no longer an option in environmentally sensitive areas and many countries and other jurisdictions are adapting strict regulations concerning the disposal of hydrocarbons. Furthermore, this method entails a substantial expense and represents a large potential liability.

It is also known in the art to use biological materials such as bacteria and enzymes to degrade hydrocarbon. Given sufficient time, the bacteria or enzymes can naturally degrade the hydrocarbon contaminants. Thus, as shown in U.S. Pat. No. 3,152,983, one may use a microbial method for the disposal of oil waste. U.S. Pat. No. 3,871,956 teaches a method for cleaning accidental oil spills on water or in a soil using a microbial method.

While such methods are known and have been proposed for a number of years, the commercial use of these methods has been rather limited due to time limitations and ineffectiveness.

SUMMARY OF THE INVENTION

It is therefore an object of the present invention to provide a microbial cleaning composition which is both effective and cost efficient.

It is a further object of the present invention to provide a method for cleaning a substrate having hydrocarbons thereon, and which process is environmentally friendly and relatively inexpensive.

According to one aspect of the present invention, there is provided a method of cleaning a substrate having an organic compound thereon, the method comprising the step of applying to the substrate a composition comprising a lignosulfonate and a microbially effective amount of microorganisms in an aqueous solution.

According to a further aspect of the present invention, there is provided a method for the preparation of a cleaning mixture for use in cleaning a substrate, the method comprising the steps of providing ammonium lignosulfonate, adjusting the pH of the ammonium lignosulfonate to a pH value of between 6.5 and 7.5, and adding a microbially effective amount of hydrocarbon degrading bacteria to the ammonium lignosulfonate.

According to a further aspect of the present invention, there is provided a cleaning solution comprising ammonium lignosulfonate, a microbially effective amount of hydrocarbon degrading bacteria mixed with the ammonium lignosulfonate, the ammonium lignosulfonate being pH adjusted to a pH value of between 6.5 and 7.5.

Preferred substrates include a marine vessel or portion thereof, a motor vehicle or portion thereof, and floors.

In a greater detail, the lignins are a natural complex polymer which are generally produced as a co-product of the paper industry, the lignins being separated from the trees by a chemical pulping process. Lignosulfonates are also known as lignin sulfonates and sulphite lignins are products of sulphite pulping. Other delignifying technologies may include the use of an organic solvent or high pressure steam treatment to remove lignins from plants.

As aforementioned, lignin is a very complex natural polymer, the exact chemical structure not being known. Physical and chemical properties can differ depending on the extraction technology. Lignosulfonates have typically been used for their dispersing, binding, complexing and emulsifying properties. Lignins have been used for many years and extensive studies have been done to test lignin impact on the environment. To date, lignins have been shown to be safe and not harmful to plants, animals and aquatic life when properly manufactured and applied. Furthermore, lignosulfonates have been found to be essentially non-toxic and non-irritating, non-mutagenic nor toxic and may be widely used in animal and human feed contact products.

The particular microbe or microbes used in conjunction with the lignosulfonates may be selected from among those known to have the property to degrade hydrocarbons. Several such microbes are described in the literature and are commercially available for the specific purpose of degrading hydrocarbons such as petroleum products.

Surprisingly, it has been found that the use of the lignosulfonate with the microbes is a very efficient and cost effective way of cleaning hydrocarbon containing substrates. Without being limited to any particular theory, it is thought that the lignosulfonates provide a readily available food source for the microbes and the lignosulfonate also helps in the cleaning. As such, the microbes are in a healthy and active state when they are placed in contact with the hydrocarbons and hence are able to reactivate themselves very quickly and thus are highly effective.

As aforementioned, the microbes may be selected from those known in the art. Such may include microorganisms of the genus Achromobacter, Actinobacter, Alcaligenes, Arthrobacter, Bacillus, Flavobacterium, Pseudomonas, and mixtures thereof. Particularly preferred are those naturally occurring non toxigenic microorganisms of the genus Bacillus, species *subtilis, licheniformis*, and *polymyxa*.

The microbial content may vary and again, is within the skill of those knowledgeable in the art to use a suitable concentration for a given condition. In a preferred embodiment, a concentrate with a viable bacterial content (CFU) in the billions of organisms per gram may be utilized. After mixing with the lignosulfonate, the concentrate may form between 0.5% to 5% by weight of the composition and with a microbial content in excess of 50,000 CCU per gram. The various strains of microorganisms can degrade and detoxify a large range of substituted and unsubstituted aliphatic and aromatic hydrocarbons.

Preferably, the composition is adjusted to have a pH of between 6.5 and 7.5 and preferably in the range of 7 (neutral). In order to do so, the naturally acidic lignosulfonate which has a pH of between 4 and 5, may have lime added thereto in an amount sufficient to bring the pH to approximately 7.

Preferably, the dry composition contains between about 80% to 91.5% by weight of ammonium lignosuifonate, between about 8% and about 15% by weight of a pH adjusting agent, and wherein said 0.5% to 5% by weight of microorganisms are a concentrated microbial product of the genus Bacillus.

Generally, the microbial content will attack and degrade phenol, benzene, toluene, other aromatic hydrocarbons with hydroxylated, nitrogenated groups, octane, ethane, and other short-chained alkyl hydrocarbons; salicylic acid, biphenyl, xylol, phenoxy alcohols, mineral oils, lubricating oils, kerosene, surfactants, gasoline, pentachlorophenol, intermediate length alkyl hydrocarbons and alcohols, fatty acids, benzolic acid and citrus oils; complex dyes, lignins, starchy complexes, carbohydrate by-product waste, wood pulp waste, structural board and pressboard waste, distillery waste, wood preservative waste, cresols, creosote, naphthalene, ethylene glycol, and heterogeneous aromatic hydrocarbon waste, protein complex wastes, oleaginous waxes or fats containing wastes, wastes with fats & oils and dissolved aromatics, hydrocarbons linked with aminos, glycerol esters; treating fuel oils, intermediate levels of moderate molecular weight hydrocarbon contamination in soil or aqueous environment, heavier machine oil, heavier grade lubricating oil; and waste from petrochemical plants, refineries, chemical formulators, pharmaceutical processors, pulp and paper mills, wood processing and treatment plants, metal machining and fabrication plants, distilleries, textiles and food processing.

The composition is not flammable and contains no known carcinogenes and is both environmentally and people friendly. The microbial stains are able to degrade the various carbon sources at temperatures ranging between 4° C. and 45° C.

Conveniently, the composition may be either used as a dry composition to be applied to the locus to be treated or alternatively, and more preferably, is used in the liquid phase. As such, the dry composition may be mixed with water in a weight volume ratio of between 2:1 and 20:1 (grams/liters).

Conveniently, the composition may be either used as a dry composition to be applied to the locust to be treated or alternatively, and more preferably, is used in the liquid phase. As such, the dry composition may be mixed with water in a weight volume ratio of between 2:1 and 20:1 (grams/liters).

DETAILED DESCRIPTION OF THE EXAMPLES

Having thus generally described the invention, reference will be made to the accompanying examples illustrating embodiments thereof.

EXAMPLE 1

On a commercially operating dredge, a product comprising anunonium lignosulfonate (86.2% by weight) and a microbial content believed to be microorganisms of the genus Bacillus, species *subtilis, licheniformis* and *polymyxa* from a product marketed under the trademark BIOZYME-6000 PC available from Ultra Biologics (1.7% by weight) in a concentration of 1.7%. The composition was adjusted to a pH of approximately 7 using lime (12.1% by weight).

The product was used in a conventional parts washing sink aboard the dredge H. R. Morris and for cleaning the bildge of work boats and tenders. The product was also used on a floating crane and the product was shown to be effective cleaning oil and hydraulic fluid drippings on exterior decks to make the deck a safer work environment for the crew.

A secondary advantage of the product is that all caustic and toxic cleaners aboard the vessels were removed leading to higher cost effectiveness and also to gain control over the possibility of toxic chemicals spilling or leaking.

EXAMPLE 2

The product of Example 1 has been used in a factory operation to clean oily production floors as well as a cleaner for machine scrubbing and hand mopping operations. The product is highly advantageous and does not leave a typical soap film residue and is also able to treat the mop water with hydrocarbon degrading microbes in the filtering and storage modes. It is believed that use of the product will enable direct discharge of the cleaning fluid.

The product was used for the cleaning of buses and performed very satisfactorily. The concrete floor of a bus washing area was black with oil that had, over the years, penetrated the pores of the concrete. After a few weeks of using the product for bus cleaning, white spots of concrete began to appear as the microbes were degrading the oil in the concrete pores.

In one embodiment, the cleaning solution may also include a citrus component to enhance the cleaning effectiveness of the solution. Many such citrus components are known in the art and are commercially available. The citrus component may be present in any desirable amount subject to it providing an enhanced cleaning effectiveness and a non-deleterious effect on the bacteria. In this regard, it is important that the solution be designed keeping in mind that certain citrus components can be harmful to certain bacteria. Accordingly, it is necessary to ensure that the combination of a particular bacteria and a particular citrus formulation are compatible.

In a preferred embodiment, the cleaning solution will use ammonium lignosulfonate in a dry powder form, a suitable microbe capable of degrading hydrocarbons, and a pH adjusting agent. The pH adjusting agent will be a material capable of raising the pH such as lime. An advantage of this dry mixture will be the shelf life and ease of shipping.

It will be understood that the above described embodiment is for purposes of illustration only and that changes and modifications may be made thereto without departing from the spirit and scope of the invention.

I claim:

1. A method of cleaning a substrate having a hydrocarbon based material thereon, the method comprising the step of applying an aqueous solution comprising lignosulfonate and hydrocarbon degrading microorganisms to said substrate, and cleaning said substrate by allowing said microorganisms to degrade the hydrocarbon based material on said substrate, wherein said substrate is selected from the group consisting of:

a) a marine vessel or portion thereof;

b) a motor vehicle or portion thereof; and c) a floor.

2. The method of claim 1 wherein said lignosulfonate is ammonium lignosulfonate.

3. The method of claim 1 wherein said aqueous solution is formed from a dry composition wherein said microorganisms are present in said dry composition in a concentration of between 0.5% and 5% by weight of the composition, said composition being diluted to form said aqueous solution at a concentration of between 2 grams and 20 grams of said composition per litre of water.

4. The method of claim 2 wherein said aqueous solution has a pH of between 6.5 and 7.5.

5. The method of claim 3 wherein said dry composition contains between about 80% to 91.5% by weight of ammonium lignosulfonate, between about 8% and about 15% by weight of a pH adjusting agent, and wherein said 0.5% to 5% by weight of microorganisms are a concentrated microbial product of tile genus Bacillus.

* * * * *